US008405558B2

(12) United States Patent
Hikino

(10) Patent No.: US 8,405,558 B2
(45) Date of Patent: Mar. 26, 2013

(54) WIRELESS DEVICE

(75) Inventor: Nozomu Hikino, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 324 days.

(21) Appl. No.: 12/920,541

(22) PCT Filed: May 18, 2009

(86) PCT No.: PCT/JP2009/059149
§ 371 (c)(1),
(2), (4) Date: Sep. 1, 2010

(87) PCT Pub. No.: WO2009/154054
PCT Pub. Date: Dec. 23, 2009

(65) Prior Publication Data

US 2011/0001674 A1 Jan. 6, 2011

(30) Foreign Application Priority Data

Jun. 19, 2008 (JP) ..... 2008-160793

(51) Int. Cl.
*H01Q 1/24* (2006.01)

(52) U.S. Cl. ..... 343/702; 343/850; 343/852; 455/562.1; 455/575.3; 455/575.7

(58) Field of Classification Search ..... 343/702, 343/876, 850, 852; 455/562.1, 575.3, 575.7
See application file for complete search history.

(56) References Cited

U.S. PATENT DOCUMENTS

2004/0219956 A1 11/2004 Iwai et al.
2004/0227673 A1 11/2004 Iwai et al.
2004/0253972 A1 12/2004 Iwai et al.
2005/0001773 A1 1/2005 Morningstar et al.
2005/0239519 A1 10/2005 Saitou et al.
2006/0071863 A1 4/2006 Lindell
2006/0097927 A1 5/2006 Satoh et al.
2006/0109185 A1 5/2006 Iwai et al.

(Continued)

FOREIGN PATENT DOCUMENTS

CN 1703895 A 11/2005
CN 101164323 A 4/2008

(Continued)

OTHER PUBLICATIONS

US Office Action for U.S. Appl. No. 12/921,528 dated Oct. 26, 2012.

*Primary Examiner* — Dieu H Duong
(74) *Attorney, Agent, or Firm* — Birch, Stewart, Kolasch & Birch, LLP

(57) ABSTRACT

A wireless device having two appropriately placed antennas can reduce deterioration in properties of an antenna included in a casing. The wireless device includes upper and lower casings, a hinge part, and at least one transmission element. The upper casing houses a casing antenna resonating with a first frequency. The lower casing houses a matching circuit of the casing antenna and houses a radio unit circuit for processing a signal having a second frequency. The hinge part joins the upper casing with the lower casing, includes a built-in antenna resonating with the second frequency, and includes feeding sections for electrically coupling the matching circuit to the casing antenna. The transmission element is disposed on a signal path connecting the built-in antenna and the radio unit circuit, and (i) gives passage to the signal having the second frequency and (ii) blocks a signal having the first frequency.

5 Claims, 7 Drawing Sheets

U.S. PATENT DOCUMENTS

| | | | | |
|---|---|---|---|---|
| 2006/0293097 | A1 | 12/2006 | Shimizu et al. | |
| 2007/0105602 | A1 | 5/2007 | Takebe | |
| 2007/0210970 | A1 | 9/2007 | Egawa et al. | |
| 2007/0225053 | A1 | 9/2007 | Iwai et al. | |
| 2008/0300028 | A1 | 12/2008 | Uejima et al. | |
| 2009/0128424 | A1 | 5/2009 | Suzuki et al. | |
| 2009/0176541 | A1 | 7/2009 | Okajima | |
| 2009/0233657 | A1 | 9/2009 | Ogawa | |
| 2011/0018773 | A1* | 1/2011 | Hikino | 343/702 |

FOREIGN PATENT DOCUMENTS

| | | | |
|---|---|---|---|
| CN | 1633145 | A | 6/2009 |
| EP | 2 023 437 | A1 | 2/2009 |
| JP | 10-308618 | A | 11/1998 |
| JP | 2002-217755 | A | 8/2002 |
| JP | 2004-229048 | A | 8/2004 |
| JP | 2004-274729 | A | 9/2004 |
| JP | 2005-328316 | A | 11/2005 |
| JP | 2006-54843 | A | 2/2006 |
| JP | 2006-67133 | A | 3/2006 |
| JP | 2006-508624 | A | 3/2006 |
| JP | 2006-514508 | A | 4/2006 |
| JP | 2006-157787 | A | 6/2006 |
| JP | 2008-72204 | A | 3/2008 |
| WO | WO 02/03665 | A1 | 1/2002 |
| WO | WO 2005/053089 | A1 | 6/2005 |
| WO | WO 2005/086363 | A1 | 9/2005 |
| WO | WO 2006/013659 | A1 | 2/2006 |
| WO | WO 2006/022331 | A1 | 3/2006 |
| WO | WO 2007/032330 | A1 | 3/2007 |
| WO | WO 2007/138682 | A1 | 12/2007 |
| WO | WO 2008/004479 | A1 | 1/2008 |

* cited by examiner

| CONNECTION EXAMPLE | ELEMENT CONFIGURATION | | |
|---|---|---|---|
| | ELEMENT A | ELEMENT B | ELEMENT C |
| a | L | C | — |
| b | L | C | L |
| | L | C | C |
| c | L | C | L |
| | L | C | C |
| d | L | C | C |
| | C | L | L |
| e | L | L | C |
| | C | C | L |
| f | L | C | — |

WIRELESS DEVICE

TECHNICAL FIELD

The present invention relates to a wireless device including two antennas that use different frequencies from each other.

BACKGROUND ART

Recently, mobile phones are often used as a type of wireless device, and mobile phones of various configurations have been developed. Among such mobile phones, foldable phones are well known, which include upper and lower casings, and in which ends of the upper and the lower casings are connected to each other as a hinge part.

For example, as shown in (a) and (b) of FIG. 8, Patent Literature 1 discloses a wireless device in which an upper casing 301 is connected to a lower casing 302 by use of a hinge 303. More specifically, in the wireless device disclosed in Patent Literature 1, the upper casing 301 includes a substrate 304 and a conductor that serves as an antenna element. The conductor is connected, via a feeding section 307, to a matching circuit 309 included in the lower casing 302. Further, the lower casing 302 has a radio unit circuit 310 provided on a substrate 305. The radio unit circuit 310 processes a high-frequency signal having a frequency with which the antenna element resonates.

As another conventional example of the foldable wireless device as disclosed in Patent Literature 1, a wireless device including two antennas that use different frequencies is also well known. Such a wireless device having two antennas has many advantages, such as that the wireless device can utilize a plurality of communication systems that have different frequencies, or that the wireless device can perform both utilization of the communication system and reception of airwaves. For example, the wireless device can perform wireless communication in accordance with a WCDMA (Wideband Code Division Multiple Access: 2 GHz) band by use of one of the two antennas, and perform reception of television airwaves in accordance with an UHF (Ultra High Frequency: 470 MHz to 770 MHz) band by use of the other one of the two antennas.

Citation List

Patent Literature

Patent Literature 1

Japanese Patent Application Publication, Tokukai, No. 2006-54843 A (Publication Date: Feb. 23, 2006)

SUMMARY OF INVENTION

Technical Problem

With a wireless device including two antennas, in a case where one of the antennas is included in an upper casing and the other one of the antennas is included in a hinge part that includes ends of the upper casing and the lower casing, antenna properties of the antenna included in the upper casing (hereinafter referred to as a casing antenna) deteriorate. The following description deals with this problem.

As in the wireless device disclosed in Patent Literature 1, in a case where a wireless device includes a casing antenna in an upper casing and includes a matching circuit of the casing antenna in a lower casing, a feeding section that couples the casing antenna to the matching circuit of the casing antenna is provided in a hinge part. Therefore, another antenna (hereinafter referred to as a built-in antenna) included in the hinge part is disposed close to the feeding section.

This causes a part of electrical capacitance of a high-frequency signal to be transmitted to the built-in antenna when the high-frequency signal having a frequency with which the casing antenna resonates passes through the feeding section, thereby reducing a gain of the casing antenna. That is, by having the built-in antenna disposed close to the feeding section, antenna properties of the casing antenna deteriorate.

The present invention is accomplished in view of the problem, and an object of the present invention is to provide a wireless device including an antenna in one of two casings, and including, in a joint part where the two casings are joined together, another antenna different from the antenna included in the casing, which wireless device is capable of reducing deterioration in properties of the antenna included in the casing.

Solution to Problem

In order to solve the foregoing problem, a wireless device of the present invention includes: a first casing, housing a first antenna that resonates with a first frequency; a second casing, housing a matching section for matching impedance with that of the first antenna and housing a signal processing section for processing a signal having a second frequency different from the first frequency; a joint part, joining the first casing with the second casing, the joint part including a second antenna that resonates with the second frequency and including a coupling section for electrically coupling the matching section to the first antenna; and a transmission element, being disposed on a signal path that connects the second antenna and the signal processing section, the transmission element (i) giving passage to the signal having the second frequency and (ii) blocking a signal having the first frequency.

According to the foregoing structure, a first antenna is coupled to a matching section by a coupling section that is included in a joint part, and a second antenna is disposed in the joint part. Therefore, both the second antenna and the coupling section are included in the joint part. As a result, the second antenna and the coupling section are disposed close to each other.

The wireless device of the present invention has a transmission element disposed on a signal path that connects the second antenna and a signal processing section. This transmission element blocks a signal having the first frequency with which the first antenna resonates. By providing the transmission element, electrical length of the second antenna is shortened in a component of the first frequency. As a result, when the signal having the first frequency with which the first antenna resonates passes through the coupling section, electrical capacitance of the signal having the first frequency, which electrical capacitance is transmitted through the coupling section to the second antenna, is reduced, thereby improving a gain of the first antenna. That is, the wireless device of the present invention reduces deterioration in properties of the first antenna, by providing the transmission element.

Accordingly, the wireless device of the present invention includes an antenna in one of two casings and includes, in a joint part where the two casings are joined together, another antenna different from the antenna included in the casing, and thus can reduce deterioration in properties of the antenna included in the casing.

ADVANTAGEOUS EFFECTS OF INVENTION

As described above, the wireless device of the present invention includes a first casing, housing a first antenna that resonates with a first frequency; a second casing, housing a matching section for matching impedance with that of the first antenna and housing a signal processing section for processing a signal having a second frequency different from the first frequency; a joint part, joining the first casing with the second casing, the joint part including a second antenna that resonates with the second frequency and including a coupling section for electrically coupling the matching section to the first antenna; and a transmission element, being disposed on a signal path that connects the second antenna and the signal processing section, the transmission element (i) giving passage to the signal having the second frequency and (ii) blocking a signal having the first frequency.

Therefore, the wireless device of the present invention is capable of reducing deterioration in properties of an antenna included in a casing, which wireless device includes an antenna in one of two casings, and includes, in a joint part where the two casings are joined together, another antenna different from the antenna included in the casing.

BRIEF DESCRIPTION OF DRAWINGS

FIG. 1 is a block diagram showing a configuration of a wireless device in accordance with an embodiment of the present invention.

FIG. 2 is a cross-sectional view showing a configuration of a wireless device in accordance with an embodiment of the present invention.

FIG. 3 is a block diagram showing an example of how reactive elements included in a filter element are connected, in a case where the filter element constructs a transmission element included in a wireless device in accordance with an embodiment of the present invention.

FIG. 4 is a chart showing an example of how reactive elements constructing a filter element are arranged, in a case where the filter element constructs a transmission element included in a wireless device, in accordance with an embodiment of the present invention.

FIG. 5 is a block diagram showing a configuration of a wireless device, in a case where an RF switch constructs a transmission element included in a wireless device, in accordance with another embodiment of the present invention.

FIG. 6 is a block diagram showing a configuration of a wireless device in accordance with yet another embodiment of the present invention.

FIG. 7 is a flowchart diagram showing a switching operation of an RF switch, in a case where the RF switch constructs a transmission element included in a wireless device, in accordance with yet another embodiment of the present invention.

FIG. 8 is a block diagram showing a configuration of a wireless device in accordance with a conventional example.

DESCRIPTION OF EMBODIMENTS

The following describes an embodiment of the present invention, with reference to drawings.

[First Embodiment]

The following describes First Embodiment of the present invention, with reference to FIGS. 1 to 4.

(Configuration of Wireless Device 1)

Figure 1:
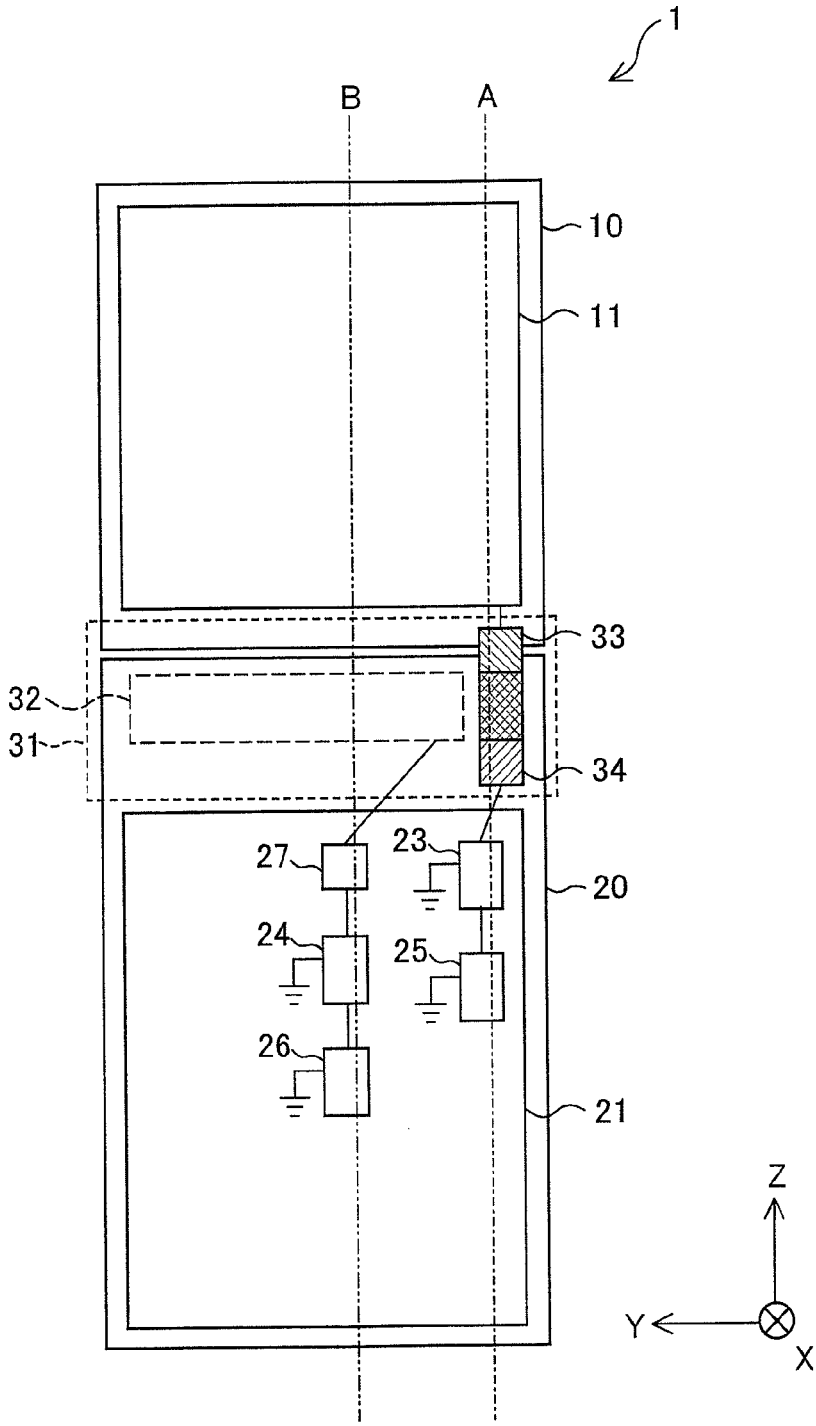
FIG. 1

The following describes a configuration of a wireless device 1 in accordance with the present embodiment, with reference to FIG. 1. FIG. 1 is a block diagram showing a configuration of the wireless device 1, in which the wireless device of the present invention is employed into a foldable phone.

As shown in FIG. 1, the wireless device 1 has two casings: an upper casing 10 (first casing) and a lower casing 20 (second casing), which two casings are joined to each other at a hinge part 31 (joint part) that includes an end of the upper casing 10 and an end of the lower casing 20. The wireless device 1 has a folded structure in which the hinge part 31 hinges the upper casing 10 and the lower casing 20. This structure allows the upper casing 10 and the lower casing 20 to be rotatable about the hinge part 31.

The upper casing 10 includes a casing antenna 11 (first antenna) that is a conductive pattern. The hinge part 31 includes a built-in antenna 32 (second antenna) that resonates with a frequency (second-frequency: hereinafter referred to as second frequency) different from a frequency (first-frequency: hereinafter referred to as first frequency) with which the casing antenna 11 resonates. The lower casing 20 includes (i) a radio unit circuit 25 that processes a high-frequency signal having the first frequency with which the casing antenna 11 resonates, (ii) a radio unit circuit 26 (signal processing section) that processes a high-frequency signal having the second frequency with which the built-in antenna 32 resonates, (iii) a matching circuit 23 (matching section) for matching impedance with that of the casing antenna 11 in accordance with the radio unit circuit 25, (iv) a matching circuit 24 for matching impedance with that of the built-in antenna 32 in accordance with the radio unit circuit 26, (v) a lower casing ground pattern 21, and (vi) a transmission element 27 that gives passage to just high-frequency signals having a specific frequency. As shown in FIG. 1, the matching circuits 23 and 24 and the radio unit circuits 25 and 26 are connected to the lower casing ground pattern 21. The transmission element 27 is described later in detail. The radio unit circuits 25 and 26 process the high-frequency signal having the first frequency and the high-frequency signal having the second frequency, respectively. The radio unit circuits and 26 have the same configurations as a conventional radio unit circuit disclosed in Patent Literature 1; thus, detailed descriptions of the radio unit circuits 25 and 26 are omitted in the present embodiment.

In the wireless device 1 of the present embodiment, the casing antenna 11 is described as an antenna that resonates with an UHF (Ultra High Frequency: 470 to 770 MHz) band, and the built-in antenna 32 is described as a multiband antenna that can resonate with a GSM (Global System for Mobile Communications: 900 MHz) band, DCS (Digital Cellular Systems: 1.8 GHz) band, PCS (Personal Communication Services: 1.9 GHz) band, and WCDMA (Wideband Code Division Multiple Access: 2 GHz) band. However, the present invention is not limited to this. The casing antenna 11 may be a multiband antenna that can resonate with a plurality of frequency bands, or the built-in antenna 32 may be an antenna that resonates with a single frequency band. As another concrete example, the casing antenna 11 may resonate with at least one of frequency bands of the UHF band, AMPS (Advanced Mobile Phone Service: 850 MHz) band, and GSM band, and the built-in antenna 32 may resonate with at least one of the frequency bands of DCS band, PCS band, and WCDMA band. In the present embodiment, as a best mode of the embodiment, the frequency bands with which the casing antenna 11 and the built-in antenna 32 resonate are as the aforementioned. However, the frequency bands with which the casing antenna 11 and the built-in antenna 32 resonate can be changed as appropriate in accordance with a specification of the wireless device, and the casing antenna 11 and the built-in antenna 32 may resonate with frequency bands other than those described above.

(Configuration of Hinge Part 31)

Figure 2:
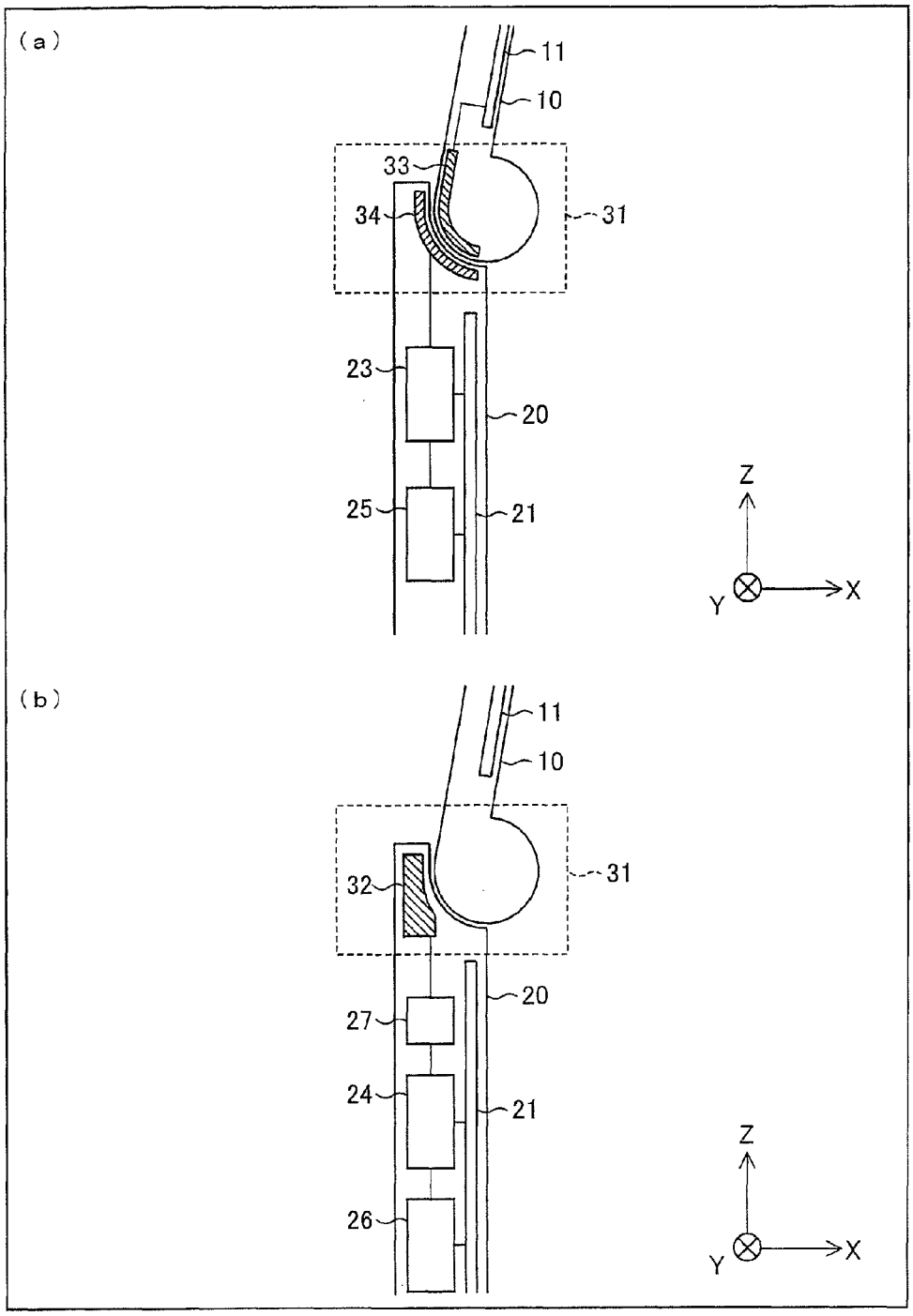
FIG. 2

The following describes a detailed configuration of the hinge part 31, with reference to (a) and (b) of FIG. 2. In FIG. 2, (a) is a cross-sectional view of the wireless device 1, taken on line A shown in FIG. 1, and (b) of FIG. 2 is a cross-sectional view of the wireless device 1, taken on line B shown in FIG. 1.

As shown in (a) of FIG. 2, the hinge part 31 includes ends of the upper casing 10 and the lower casing 20; in other words, the hinge part 31 is a part where the upper casing 10 and the lower casing 20 overlap each other. Further, the hinge part 31 of the upper casing 10 includes a feeding section 33 (first conductor section), and the hinge part 31 of the lower casing 20 includes a feeding section 34 (second conductor section). These feeding sections 33 and 34 are made of conductive material, and are disposed separately from each other. Therefore, the feeding sections 33 and 34 are disposed in a non-conductive manner in terms of continuous current, however are coupled to each other by electrostatic capacitance determined by areas and distances of the feeding sections 33 and 34 that face each other. In other words, the feeding sections 33 and 34 are electromagnetically coupled to each other, and give passage to the high-frequency signal having the first frequency with which the casing antenna 11 resonates.

As shown in (b) of FIG. 2, the hinge part 31 of the lower casing 20 includes the built-in antenna 32. This built-in antenna 32 is connected to the matching circuit 24 via the transmission element 27. Therefore, the high-frequency signal having the second frequency with which the built-in antenna 32 resonates is transmitted to the radio unit circuit 26 via the transmission element 27 and the matching circuit 24, and is processed in the radio unit circuit 26.

It should be noted that, as shown in (a) of FIG. 2, the wireless device 1 of the present embodiment has the transmission element 27 provided on a signal path that connects the built-in antenna 32 and the matching circuit 24. The following describes the transmission element 27.

The upper casing 10 of the present embodiment is constructed of a cabinet (not shown) that is made of resin material, and the cabinet made of the resin material includes the casing antenna 11 and the feeding section 33. However, the present invention encompasses a structure in which the feeding section 33 and the cabinet of the upper casing 10 are integrated as one structure. Further, another example of a configuration of the feeding section 33 is a configuration in which the feeding section 33 is constructed by a FPC (Flexible Printed Circuits).

Similarly, the lower casing 20 of the present embodiment is constructed of a cabinet (not shown) that is made of resin material, and the cabinet made of the resin material includes the built-in antenna 32, the feeding section 34, the transmission element 27, the matching circuits 23 and 24, and the radio unit circuits 25 and 26. However, the present invention encompasses a structure in which the feeding section 34 and the cabinet of the lower casing 20 are integrated as one structure. Further, another example of a configuration of the feeding section 34 is a configuration in which the feeding section 34 is constructed by the FPC (Flexible Printed Circuits).

Further, in the present embodiment, the cabinet of the upper casing 10 is made of the resin material, and the casing antenna 10 is provided separately from the cabinet. However, the present invention also encompasses a structure in which the cabinet of the upper casing 10 is made of conductive material such as a metal case, and this cabinet made of the conductive material is used as the casing antenna 11.

(Configuration of Transmission Element 27)

The following describes the transmission element 27 included in the wireless device 1 of the present embodiment. The transmission element 27 included in the wireless device 1 has properties of (i) blocking the high-frequency signal having the first frequency with which the casing antenna 11 resonates and (ii) giving passage to the high-frequency signal having the second frequency with which the built-in antenna 32 resonates. The transmission element 27 having these properties is constructed of a filter element in which reactive elements of a coil, a capacitor and the like are used in combination.

Figure 3:
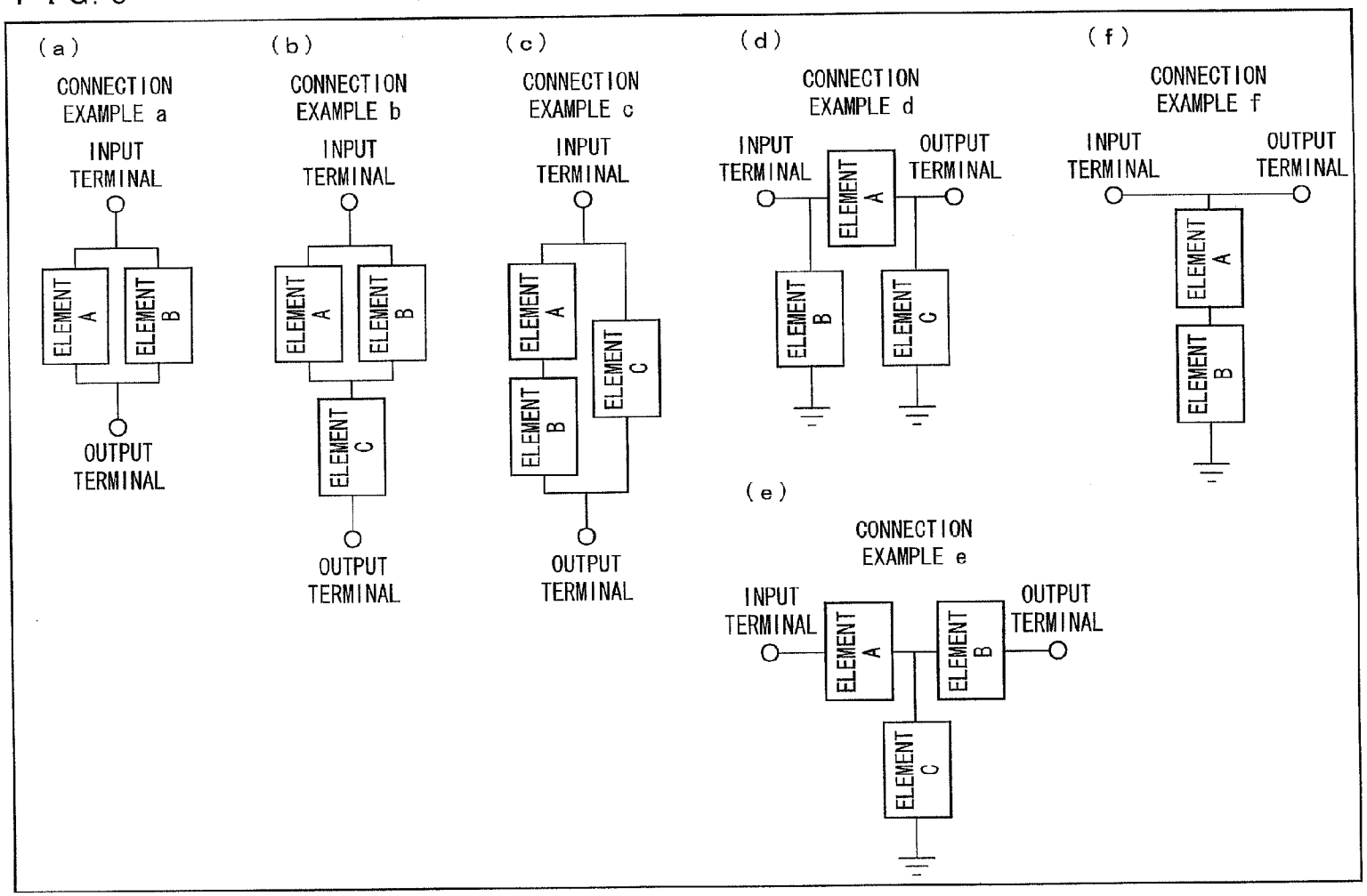
FIG. 3
Figures 4, 5:
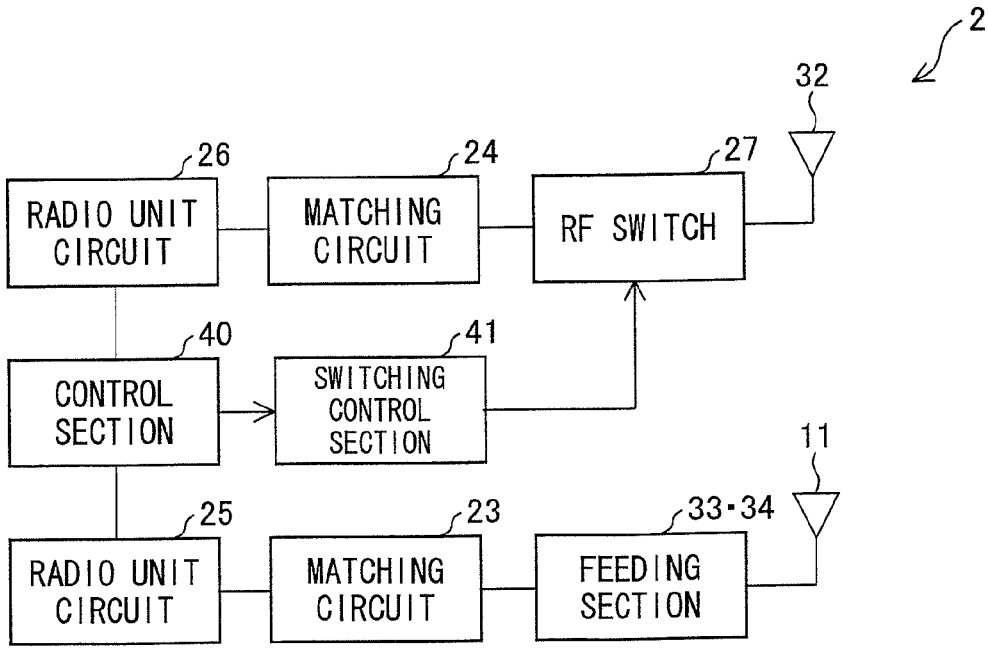
FIG. 4
FIG. 5

The following describes examples of configurations of the transmission element 27 having the foregoing properties, with reference to (a) to (f) of FIG. 3, and FIG. 4. In FIG. 3, (a) to (f) are block diagrams of examples showing connection examples "a" to "f" of reactive elements in a filter element, in cases where the transmission element 27 is constructed of the filter element in which the reactive elements of a capacitor, a coil and the like are used in combination. FIG. 4 is a chart showing an example of how the reactive elements are arranged in the connection examples "a" to "f" shown in (a) to (f) of FIG. 3.

Element A, element 13, and element C shown in (a) to (f) of FIG. 3 each have a coil or a capacitor disposed thereto, in accordance with the respective connection examples. Further, the built-in antenna 32 is to be connected to input terminals shown in (a) to (f) of FIG. 3, and the matching circuit 24 is to be connected to output terminals shown in (a) to (f) of FIG. 3.

As shown in (a) of FIG. 3, the filter element may be constructed so that the elements A and B are connected in parallel between the input terminal and the output terminal. In the connection example "a", as shown in FIG. 4, a coil is disposed to the element A, and a capacitor is disposed to the element B.

As shown in (b) of FIG. 3, the filter element may be constructed so that the element A and the element B are connected in parallel between the input terminal and the output terminal, and the element A and the element B are connected to each other on their output terminal sides to connect the element C in series between the connection of the elements A and B and the output terminal. In the connection example "b", as shown in FIG. 4, a coil is disposed to the element A, a capacitor is disposed to the element B, and a coil or a capacitor is disposed to the element C.

As shown in (c) of FIG. 3, the filter element may be constructed so that the element A and the element B are connected in series between the input terminal and the output terminal, and the element C is connected in parallel with the elements A and B. In the connection example "c", as shown in FIG. 4, a coil is disposed to the element A, a capacitor is disposed to the element B, and a coil or a capacitor is disposed to the element C.

As shown in (d) of FIG. 3, the filter element may be constructed so that the element A is connected between the input terminal and the output terminal, the element B is connected between (i) a connection point of the element A and the input terminal and (ii) a ground pattern, and the element C is connected between (i) a connection point of the element A and the output terminal and (ii) a ground pattern. The connection example "d", as shown in FIG. 4, has two arrangement examples: one arrangement example is a case where a coil is disposed to the element A, and a capacitor is disposed to each of the elements B and C; and the other arrangement example is a case where a capacitor is disposed to the element A, and a coil is disposed to each of the elements B and C.

As shown in (e) of FIG. 3, the filter element may be constructed so that the element A and the element B are connected in series between the input terminal and the output terminal, and the element C is connected between (i) a connection point of the element A and the element B and (ii) a ground pattern. The connection example "e", as shown in FIG. 4, has two arrangement examples: one arrangement example is a case where a coil is disposed to each of the elements A and B, and a capacitor is disposed to the element C; and the other arrangement example is a case where a capacitor is disposed to each of the elements A and B, and a coil is disposed to the element C.

As shown in (f) of FIG. 3, the filter element may be constructed so that the input terminal is connected to the output terminal via a wiring, and the element A and the element B are connected in series between the wiring and a ground. In the connection example "f", as shown in FIG. 4, a coil is disposed to the element A, and a capacitor is disposed to the element B.

The reactive elements constructing the transmission element 27 have inductance values and capacitance values set as appropriate in accordance with the connection examples in FIG. 3 and the arrangement example in FIG. 4, so that the transmission element 27 has the properties of (i) blocking the high-frequency signal having the first frequency, and (ii) giving passage to the high-frequency signal having the second frequency. Further, connection and arrangement of the reactive elements constructing the transmission element 27 are not limited to the connection examples shown in FIG. 3 and the arrangement example shown in FIG. 4; as long as the transmission element 27 has the foregoing properties, other connections and arrangements may be employed. The transmission element 27 may also be made by using, in combination, a plurality of filters that have the structures such as ones shown in (a) to (f) of FIG. 3. Concretely, the transmission element 27 may be made by using two of the filter shown in (a) of FIG. 3 in combination. The transmission element 27 may also be made by using, in combination, the filters shown in (a) and (d) of FIG. 3. In the present embodiment, the reactive elements of the coil, the capacitor and the like are used to construct the transmission element 27 by use of the filter element. However, the present invention is not limited to this. The transmission element 27 may be constructed by use of dielectric filters. Another example of the configuration of the transmission element 27 constructed of the filter element is a configuration in which the transmission element 27 is formed by a signal line pattern formed on a FPC (Flexible Printed Circuits), a wiring substrate or the like.

As described above, in the wireless device 1 of the present embodiment, by providing the transmission element 27, electrical length of the built-in antenna 32 is shortened, in accordance with the first frequency with which the casing antenna 11 resonates. As a result, when the high-frequency signal having the first frequency passes through the feeding sections 33 and 34, electrical capacitance of the high-frequency signal having the first frequency is reduced, which electrical capacitance is transmitted to the built-in antenna 32 from the feeding sections 33 and 34. This improves a gain of the casing antenna 11.

In the present embodiment, the wireless device 1 includes the transmission element 27 on the signal path that connects the built-in antenna 32 and the matching circuit 24. However, the wireless device 1 may include the transmission element 27 on a signal path that connects the matching circuit 24 and the radio unit circuit 26. This also improves antenna properties of the casing antenna 11.

In the present embodiment, the feeding section 33 is non-conductively but electromagnetically coupled to the feeding section 34. However, the present invention is not limited to this. The present invention may include such a configuration that the feeding section 33 is in contact with and is electrically connected to the feeding section 34. Even with this case, the wireless device 1 yields the same effect as that described above.

Further, in the present embodiment, the wireless device 1 has a folded structure in which the hinge part 31 hinges the upper casing 10 and the lower casing 20. However, the present invention is not limited to this. The present invention may include a slide type structure in which the upper casing 10 slides on the lower casing 20.

In the present embodiment, the built-in antenna 32 is included in the hinge part 31 of the lower casing 20. However, the present invention is not limited to this, and the built-in antenna 32 may be included in the hinge part 31 of the upper casing 10.

(Second Embodiment)

In First Embodiment described above, the transmission element 27 is constructed of the filter element. The present invention may have the transmission element 27 be constructed of a RF switch instead of the filter element, which RF switch is a switching element.

The following describes a wireless device 2 as Second Embodiment of the present invention, with reference to FIG. 5, in which the transmission element 27 is constructed of the RF switch. FIG. 5 is a block diagram showing a configuration of the wireless device 2, in the case where the transmission element 27 is constructed of the RF switch. The wireless device 2 has a basic structure identical to that of the wireless device 1 described in First Embodiment. Therefore, descriptions are provided for points that are different from those of the wireless device 1 of First Embodiment; identical reference signs are provided to members having identical features and functions with the members of the foregoing wireless device 1, and descriptions of such identical members are omitted in the embodiment.

(Configuration of Wireless Device 2)

As shown in FIG. 5, the wireless device 2 in which the transmission element 27 is constructed of the RF switch further includes, in addition to the configuration of the wireless device 1 shown in FIG. 1, a switching control section 41 for controlling the transmission element 27 constructed of the RF switch, and a control section 40 which outputs an instruction signal to the switching control section 41. In FIG. 5, an RF switch 27 is the transmission element 27.

(Switching Operation of RF Switch 27)

The control section 40 detects, by the radio unit circuit 26, whether or not a system of the casing antenna 11 is activated, in other words, whether or not the casing antenna 11 is used. In accordance with this detected result, the control section 40 outputs, to the switching control section 41, an instruction signal for instructing the switching control section 41 to turn the RF switch 27 ON and OFF, in other words, an instruction signal for instructing the switching control section 41 to switch between electrically connecting and electrically disconnecting the built-in antenna 32 and the matching circuit 24. Further, in accordance with the outputted instruction signal, the switching control section 41 turns the RF switch 27 ON and OFF.

That is, while the built-in antenna 32 is used, the control section 40 causes the RF switch 27 to be turned ON by the switching control section 41. As a result, the built-in antenna 32 is electrically connected to the matching circuit 24. Whereas, while the built-in antenna 32 is not used, the control section 40 causes the RF switch 27 to be turned OFF by the switching control section 41. As a result, the built-in antenna 32 is electrically disconnected from the matching circuit 24.

In the present embodiment, the wireless device 2 has the transmission element 27 provided on the signal path that connects the built-in antenna 32 and the matching circuit 24. However, the wireless device 2 may have the transmission element 27 provided on a signal path that connects the matching circuit 27 and the radio unit circuit 26. Even with this case, the antenna properties of the casing antenna 11 are improved in the wireless device 2.

In First and Second Embodiments described above, the transmission element 27 is constructed of the filter element or the RF switch. However, the transmission element 27 may be constructed of a combination of the filter element described in First Embodiment and the RF switch described in Second Embodiment.

(Third Embodiment)

Figure 6:
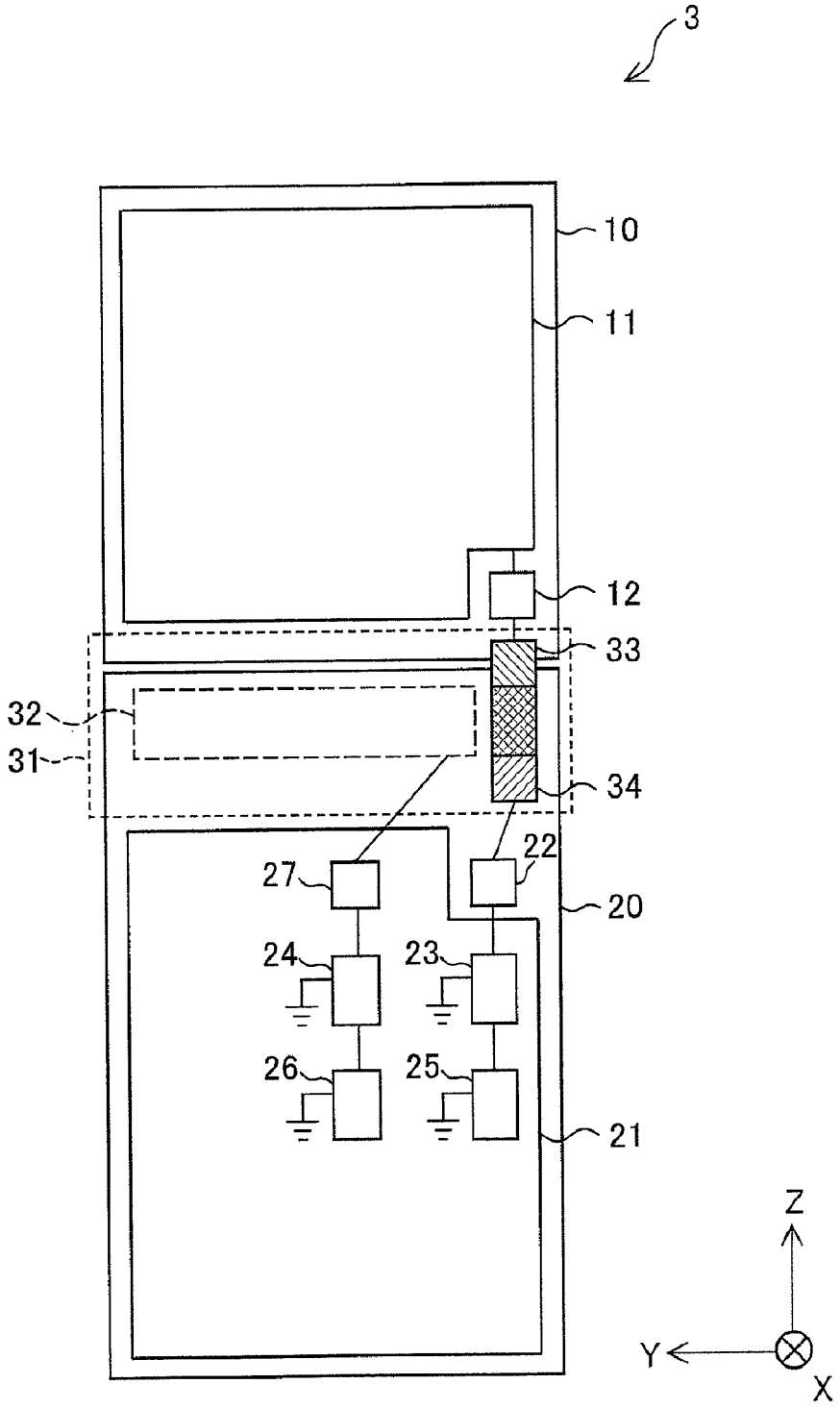
FIG. 6

The following describes Third Embodiment of the present invention, with reference to FIG. 6. FIG. 6 is a block diagram showing a configuration of a wireless device 3 of the present embodiment. The wireless device 3 of Third Embodiment described below is a modification of the wireless device 1 of First Embodiment. Therefore, in the following description of Third Embodiment, explanations are provided for points different from those of First Embodiment described above; identical reference signs are provided to members that have identical features and functions with the members of First Embodiment, and descriptions of such identical members are omitted in the embodiment.

As shown in FIG. 6, the wireless device 3 of the present embodiment differs from the wireless device 1 of First Embodiment in that the wireless device 3 has the transmission element 12 provided on a signal path that connects the casing antenna 11 and the feeding section 33, and has the transmission element 22 provided on a signal path that connects the feeding section 34 and the matching circuit. The transmission elements 12 and 22 have properties different from those of the transmission element 27.

Before an effect of the wireless device 3 that includes the transmission elements 12 and 22 is described, a problem that can occur in a wireless device including two antennas that are disposed in respective upper casing and hinge part, is described. Concretely, in a wireless device including two antennas, when (i) one of the two antennas is included in the upper casing, (ii) a matching circuit of this antenna is included in a lower casing, and (iii) the other of the two antennas is included in the hinge part that includes ends of the upper and the lower casings, the antenna included in the hinge part (hereinafter referred to as a built-in antenna) and a feeding section of the antenna included in the upper casing (hereinafter referred to as a casing antenna) are disposed close to each other in the hinge part. As already described, the built-in antenna being disposed close to the feeding section of the casing antenna causes deterioration in properties of the casing antenna. Not only this, the built-in antenna being disposed close to the feeding section of the casing antenna can also cause a problem that antenna properties of the built-in antenna deteriorate. More specifically, the feeding section of the casing antenna is connected to the casing antenna that serves as a ground of the upper casing, and further is connected to a ground of the lower casing via the matching circuit. Therefore, the feeding section of the casing antenna serves as a conductor of the ground of the built-in antenna. Conventionally, it has been known that, in a case where a ground is disposed close to an antenna, antenna properties of the antenna deteriorate. Therefore, by having the feeding section of the casing antenna disposed close to the built-in antenna, the ground is disposed close to the built-in antenna, thereby causing deterioration in the antenna properties of the built-in antenna.

However, the wireless device 3 of the present embodiment has the transmission element 12 provided on the signal path that connects the casing antenna 11 and the feeding section 33, and has the transmission element 22 provided on the signal path that connects the feeding section 34 and the matching circuit 23. This makes it possible to reduce deterioration in properties of the built-in antenna 32, which deterioration is caused by having the feeding sections 33 and 34 disposed close to the built-in antenna 32.

The following describes the effect of the wireless device 3. The transmission elements 12 and 22 have properties of (i) giving passage to the high-frequency signal having the first frequency with which the casing antenna 11 resonates and (ii) blocking the high-frequency signal having the second frequency with which the built-in antenna 32 resonates.

As described above, the transmission elements 12 and 22 are capable of blocking the high-frequency signal having the second frequency. Therefore, in the second frequency with which the built-in antenna 32 resonates, the feeding section 33 is disconnected from the casing antenna 11 that is the ground pattern, and the feeding section 34 is disconnected from the lower casing ground pattern 21. As a result, in the second frequency, in other words, for the built-in antenna 32, the feeding sections 33 and 34 disposed close to the built-in antenna 32 are disconnected from the ground patterns. Therefore, the feeding sections 33 and 34 disposed close to the built-in antenna 32 less serve as a ground, thereby increasing electrical volume of the built-in antenna 32. As a result, the wireless device 3 is capable of reducing deterioration in the properties of the built-in antenna 32, which deterioration is caused by the ground patterns being disposed close to the built-in antenna 32.

The transmission elements 12 and 22 may be constructed of the filter elements made of the reactive elements shown in (a) to (e) of FIG. 3 and FIG. 4 described in First Embodiment. In this case where the transmission elements 12 and 22 are constructed of the filter elements, the reactive elements constructing the filter elements have inductance values and capacitance values set as appropriate in accordance with connection examples shown in (a) to (e) of FIG. 3 and an arrangement example shown in FIG. 4, so that the transmission elements 12 and 22 have properties of (i) giving passage to the high-frequency signal having the first frequency, and (ii) blocking the high-frequency signal having the second frequency. Further, connection and arrangement of the reactive elements constructing the transmission elements 12 and 22 are not limited to the connection examples shown in FIG. 3 and arrangement example shown in FIG. 4; as long as the transmission elements 12 and 22 have the foregoing properties, other connections and arrangements may be employed. Furthermore, it is not necessary to have the transmission element 12 be connected and disposed in the same manner as the transmission element 22. The transmission elements 12 and 22 may be connected and disposed differently from each other. The transmission elements 12 and 22 may also be made by using, in combination, a plurality of filters that have the structures such as ones shown in (a) to (e) of FIG. 3. Concretely, the transmission elements 12 and 22 may be made by using two of the filter shown in (a) of FIG. 3 in combination. The transmission elements 12 and 22 may also be made by using, in combination, the filter shown in (a) of FIG. 3 and that shown in (d) of FIG. 3. In the present embodiment, the reactive elements of the coil, the capacitor and the like are used in order to construct the transmission elements 12 and 22 by use of the filter elements. However, the present invention is not limited to this. The transmission elements 12 and 22 may be constructed by use of dielectric filters.

Another example of the configuration of the transmission elements 12 and 22 constructed of the filter elements includes a configuration in which the transmission elements 12 and 22 are formed by a signal line pattern formed on a FPC (Flexible Printed Circuits), a wiring substrate or the like. The configuration makes it possible to construct the feeding section 33 and the feeding section 34 of the FPC, and to make one FPC serve as the feeding section and the transmission element. Concretely, the configuration allows constructing the feeding section 33 by use of the FPC, forming the transmission element 12 by use of the signal line pattern of the FPC, and integrating the function as the feeding section 33 and the function as the transmission element 12 into a single FPC.

Further, the transmission elements 12 and 22 may be constructed of the RF switches that are the switching elements, instead of the filter elements described above. In this case, the wireless device 3 includes the control section 40 and the switching control section 41 included in the wireless device 2 of Second Embodiment; and the RF switches are turned ON and OFF by the control section 40 and the switching control section 41. By turning the RF switches ON, the casing antenna 11 and the radio unit circuit 25 become electrically connected to each other. On the other hand, by turning the RF switches OFF, the casing antenna 11 and the radio unit circuit 25 become electrically disconnected from each other. This definition also applies in the following descriptions.

Figure 7:
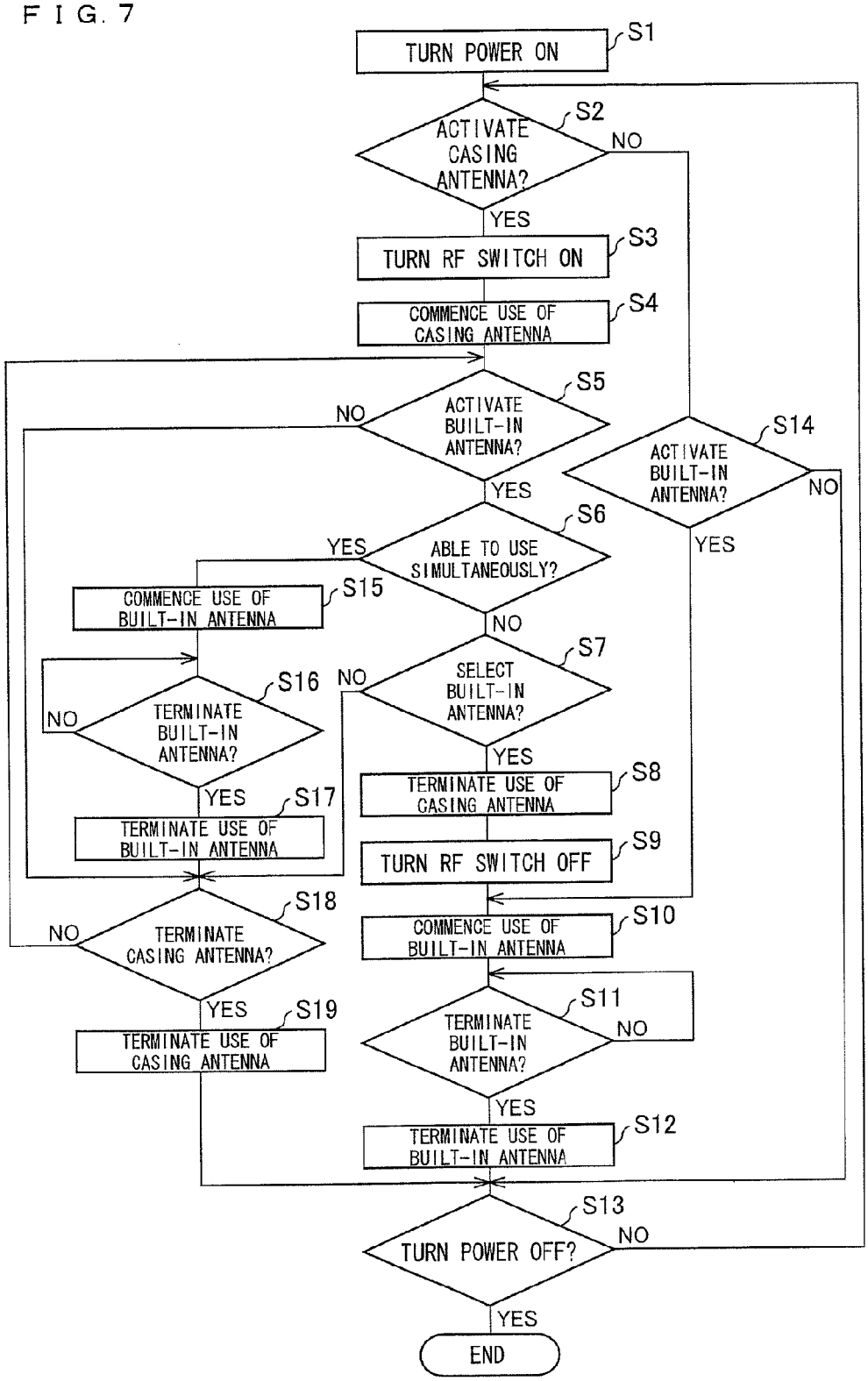
FIG. 7
Figure 8:
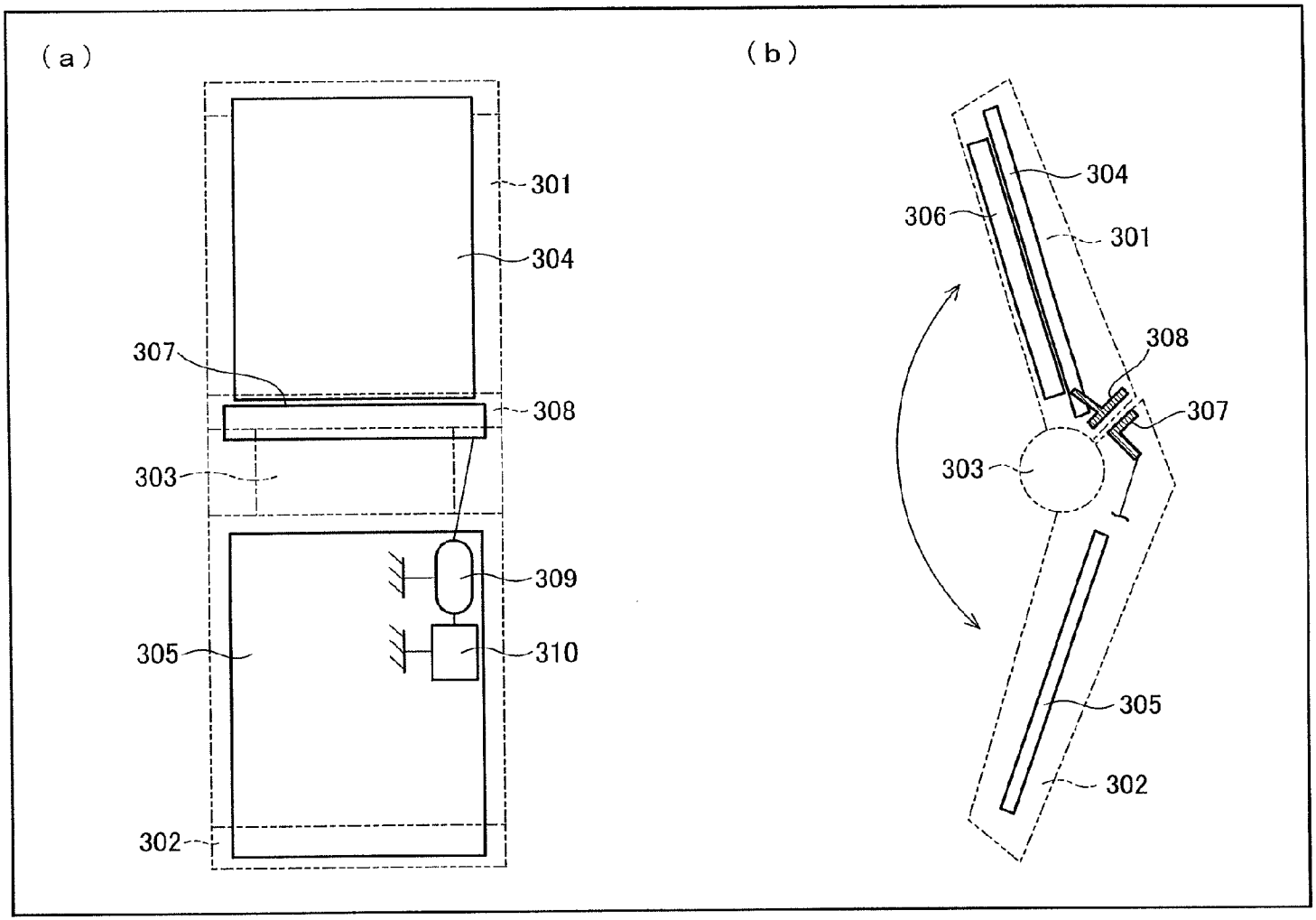
FIG. 8

The following describes switching operations of the RF switches in the case where the transmission elements 12 and 22 are constructed of the RF switches, with reference to a flowchart shown in FIG. 7. Hereinafter, the transmission element 12 constructed of the RF switch is referred to as an RF switch 12, and the transmission element 22 constructed of the RF switch is referred to as an RF switch 22.

First, power of the wireless device 3 is turned ON by a user of the wireless device 3 (step 1: hereinafter referred to as S1). Thereafter, the control section 40 detects, by use of a user interface (not shown) or the radio unit circuit 25, whether or not the casing antenna 11 is activated (S2). The casing antenna 11 is activated in a case where the user interface detects an instruction, from the user, to commence television reception of an UHF band, which is of the first frequency.

The control section 40, upon detection of activation of the casing antenna 11 in S2, outputs, to the switching control section 41, an instruction signal for instructing the switching control section 41 to turn the RF switches 12 and 22 ON. In accordance with the instruction signal outputted to the switching control section 41, the switching control section 41 turns the RF switches 12 and 22 ON (S3). Meanwhile, in S2, if the control section 40 detects that the casing antenna 11 is not activated, the control section 40 proceeds to a process of S14.

Next, in S3, when the control section 40 turns the RF switches 12 and 22 ON by the switching control section 41, then the wireless device 3 starts using a communication system of a first frequency, by use of the casing antenna 11 (S4).

Next, in S4, once the wireless device 3 starts using the communication system of the first frequency, the control section 40 detects whether or not the built-in antenna 32 is activated, by use of the user interface (not shown) or the radio unit circuit 26 (S5). The built-in antenna 32 is activated when the user interface detects an instruction, from the user, to commence use of a communication system of a second frequency, or when the built-in antenna 32 and the radio unit circuit 26 receive a call signal from a base station in a case where the communication system of the second frequency is a two-way communication system such as voice communication.

Once the control section 40 detects, in S5, that the built-in antenna 32 is activated, then the control section 40 compares the first frequency with which the casing antenna 11 resonates with the second frequency with which the built-in antenna 32 resonates, and determines whether or not the communication system of the first frequency and the communication system of the second frequency are usable simultaneously (S6). On the other hand, when the control section 40 detects that the built-in antenna 32 is not activated, the control section 40 proceeds to a process of S18. The casing antenna 11 and the built-in antenna are multiband antennas. Therefore, the casing antenna 11 can resonate with, as the first frequency, a plurality of frequencies that are used by a plurality of communication systems. The built-in antenna 32 also can resonate with, as the second frequency, a plurality of frequencies used by a plurality of communication systems, which a plurality of frequencies are different from those with which the casing antenna 11 can resonate.

In a case where the control section 40 determines, in S6, that the communication system of the first frequency and the communication system of the second frequency are usable simultaneously, the control section 40 proceeds to a process of S15. However, in a case where the control section 40 determines that the foregoing two communication systems cannot be used simultaneously, the control section 40 informs the user that the foregoing two communication systems cannot be used simultaneously, and detects which of the two communication systems: the communication system for using the casing antenna 11 or the communication system for using the built-in antenna 32, is selected by the user (S7). In the present embodiment, either one of the two communication systems is selected by the user in S7. However, the present invention is not limited to this. The control section 40 may set priorities, in advance, to the frequency with which the casing antenna 11 resonates and the plurality of frequencies with which the built-in antenna 32 resonates, and the control section 40 may automatically select the communication system to be used, that is, the antenna to be used, in accordance with the priorities set in advance.

In S7, once the control section 40 detects that the communication system for using the built-in antenna 32 is selected, the control section 40 then outputs, to the radio unit circuit 25, an instruction for terminating use of the casing antenna 11 (S8). Meanwhile, when the control section 40 detects that the communication system for using the casing antenna 11 is selected, the control section 40 proceeds to the process of S18.

After performing the process of S8, the control section 40 outputs, to the switching control section 41, an instruction signal for instructing the switching control section 41 to turn the RF switches 12 and 22 OFF. In accordance with the instruction signal, the switching control section 41 turns the RF switches 12 and 22 OFF (S9). After the RF switches 12 and 22 are turned OFF, the wireless device 3 starts using the communication system of the second frequency by use of the built-in antenna 32 (S10).

The wireless device 3 that has started using the communication system of the second frequency continuously uses the communication system of the second frequency until the control section 40 detects, by the user interface (not shown) or the radio unit circuit 26, that use of the built-in antenna 32 is terminated (S11). The use of the built-in antenna 32 is terminated when the user interface detects an instruction, from the user, to terminate the use of the communication system of the second frequency, or when the built-in antenna 32 and the radio unit circuit 26 receive a disconnection signal, from the base station, for disconnecting a communication link in a case where the communication system of the second frequency is the two-way communication system such as the voice communication.

Once the control section 40 detects, in S11, that the use of the built-in antenna 32 is terminated, the wireless device 3 terminates use of the communication system of the second frequency (S12). After performing the process of S12, the control section 40 detects whether or not the user interface (not shown) receives an instruction, from the user, to turn the wireless device 3 OFF. When the control section 40 detects that the user interface receives the instruction to turn the wireless device 3 OFF, the wireless device 3 is powered down by itself, and terminates its own operation process. Meanwhile, if the control section 40 does not detect, by the user interface, the instruction to turn the wireless device 3 OFF, the control section 40 proceeds to the process of S2.

Further, in a case where the control section 40 detects, in S3, that the casing antenna 11 is not activated, the control section 40 then detects, by the user interface (not shown) or the radio unit circuit 26, whether or not the built-in antenna 32 is activated (S14). In a case where the control section 40 detects that the built-in antenna 32 is not activated, the control section 40 proceeds to the process of S13. In a case where the control section 40 detects that the built-in antenna 32 is activated, the control section 40 proceeds to the process of S10.

Once the control section 40 detects, in S5, that the built-in antenna 32 is not activated, the control section 40 then detects whether or not the user interface (not shown) or the radio unit circuit 25 receives an instruction or signal for terminating the use of the casing antenna 11 (S18). Use of the casing antenna 11 is terminated in the case where the user interface detects an instruction, from the user, for terminating the television reception of the UHF band that is of the first frequency.

When the control section 40 detects, in S18, that the use of the casing antenna 11 is terminated, the wireless device 3 terminates use of the communication system of the first frequency (S19). After the process of S19 is performed, the control section 40 proceeds to the process of S13. On the other hand, if the control section 40 detects, in S18, that the use of the casing antenna 11 is not terminated, then the control section 40 proceeds to the process of S5.

In the case where the control section 40 determines, in S6, that the communication system of the first frequency and the communication system of the second frequency are usable simultaneously, the wireless device 3 starts using the communication system of the second frequency by using the built-in antenna 32 (S15).

The wireless device 3 that has started using the communication system of the second frequency continuously uses the communication system of the second frequency until the control section 40 detects, by the user interface (not shown) or the radio unit circuit 26, that the use of the built-in antenna 32 is terminated (S16). Once the control section 40 detects, in S16, that the use of the built-in antenna 32 is terminated, then the wireless device 3 terminates the use of the communication system of the second frequency (S17), and the control section 40 proceeds to the process of S18.

As described above, the control section 40 obtains, by the user interface (not shown) or the radio unit circuit 25, information indicating whether or not the casing antenna 11 is activated, in other words, information indicating whether or not the casing antenna 11 is used. Further, the control section 40 also obtains, by the user interface (not shown) or the radio unit circuit 26, information indicating whether or not the built-in antenna 32 is activated, in other words, information indicating whether or not the built-in antenna 32 is used. In accordance with the two obtained information, the switching control section 41 turns the RF switches 12 and 22 ON and OFF. Therefore, when the wireless device 3 uses the communication system of the second frequency by use of the built-in antenna 32 in the case where the casing antenna 11 is not activated, the feeding sections 33 and 34 disposed close to the built-in antenna 32 are disconnected from the ground patterns. This reduces deterioration in properties of the built-in antenna 32, which deterioration is caused by the feeding sections 33 and 34 being disposed close to the ground patterns.

The wireless device 3 of the present embodiment includes both the transmission elements 12 and 22. However, the present invention is not limited to this. The wireless device 3 of the present embodiment may just include any one of the transmission elements 12 and 22.

Concretely, the wireless device 3 may include no transmission element 22, but include just the transmission element 12. The transmission element 12 included in the wireless device 3 disconnects the feeding section 33 from the casing antenna 11 that serves as the ground pattern of the upper casing 10, in the second frequency with which the built-in antenna 32 resonates. As a result, the wireless device 3 has the feeding sections 33 and 34 less serve as a ground than in a case where the wireless device 3 includes no transmission element 12. This increases the electrical volume of the built-in antenna 32, thereby reducing the deterioration in the properties of the built-in antenna 32.

Further, the wireless device 3 may include no transmission element 12, but include just the transmission element 22. The transmission element 22 included in the wireless device 3 disconnects the feeding section 34 from the lower casing ground pattern 21, in the second frequency with which the built-in antenna 32 resonates. As a result, the wireless device 3 has the feeding sections 33 and 34 less serve as a ground than in a case where the wireless device 3 includes no transmission element 22. This increases the electrical volume of the built-in antenna 32, thereby reducing the deterioration in the properties of the built-in antenna 32 as a result.

In Third Embodiment described above, the transmission elements 12 and 22 are constructed of the filter elements or the RF switches, respectively. However, the transmission elements 12 and 22 may be constructed of a combination of the above-mentioned filter elements and RF switches.

As described above, the wireless device of the present embodiment includes a first casing, housing a first antenna that resonates with a first frequency; a second casing, housing a matching section for matching impedance with that of the first antenna and housing a signal processing section for processing a signal having a second frequency different from the first frequency; a joint part, joining the first casing with the second casing, the joint part including a second antenna that resonates with the second frequency and including a coupling section for electrically coupling the matching section to the first antenna; and a transmission element, being disposed on a signal path that connects the second antenna and the signal processing section, the transmission element (i) giving passage to the signal having the second frequency and (ii) blocking a signal having the first frequency.

According to the foregoing structure, a first antenna is coupled to a matching section by a coupling section included in a joint part, and a second antenna is disposed in the joint part. Therefore, both the second antenna and the coupling section are included in the joint part. As a result, the second antenna and the coupling section are disposed close to each other.

The wireless device of the present invention has a transmission element disposed on a signal path that connects the second antenna and a signal processing section. This transmission element blocks a signal having the first frequency with which the first antenna resonates. By providing the transmission element, electrical length of the second antenna is shortened in a component of the first frequency. As a result, when the signal having the first frequency with which the first antenna resonates passes through the coupling section, electrical capacitance of the signal having the first frequency, which electrical capacitance is transmitted through the coupling section to the second antenna, is reduced, thereby improving a gain of the first antenna. That is, the wireless device of the present invention reduces deterioration in properties of the first antenna, by providing the transmission element.

As described above, the wireless device of the present invention includes an antenna in one of two casings, and includes, in a joint part where the two casings are joined together, another antenna different from the antenna included in the casing, and thus can reduce deterioration in properties of the antenna included the casing.

It is preferable to arrange the wireless device of the present invention such that the coupling section includes a first conductor section connected to the first antenna and a second conductor section connected to the matching section, the first conductor section being electromagnetically coupled to the second conductor section.

According to the foregoing structure, a first conductor section and a second conductor section, which are the coupling sections, are electromagnetically coupled to each other. This makes it possible to dispose the first and the second conductor sections separately from each other. The first conductor section is connected to the first antenna included in the first casing. Therefore, the first conductor section is disposed in the first casing. The second conductor section is connected to the matching section included in the second casing. Therefore, the second conductor section is disposed in the second casing.

When the first casing moves in accordance with the second casing, physical stress given on the coupling section by the movement of the first casing is remarkably reduced in a case where the coupling section includes the first conductor section and the second conductor section that are disposed separately from each other, as compared to a case where the coupling section is made of one conductor. As a result, the wireless device of the present invention having the foregoing structure can further hold down occurrence of poor electrical connection between the first casing and the second casing as compared to a wireless device in which the coupling section is made of one conductor.

It is preferable to arrange the wireless device of the present invention such that the transmission element is a filter element.

The foregoing structure allows the transmission element constructed of the filter element to give passage to the signal having the second frequency, and to block the signal having the first frequency, even if the signal having the first frequency with which the first antenna resonates and the signal having the second frequency with which the second antenna resonates are simultaneously transmitted to the transmission element. As a result, the wireless device can still reduce the deterioration in the properties of the first antenna, even if the wireless device simultaneously uses two communication systems that have different frequency bands from each other by using the first antenna and the second antenna simultaneously.

It is preferable to arrange the wireless device of the present invention such that the transmission element is a switching element that switches between electrically connecting and electrically disconnecting the second antenna and the signal processing section, based on whether or not the second antenna is used.

The foregoing structure allows the wireless device of the present invention to electrically disconnect the second antenna from the signal processing section, in a case where the second antenna is not used. This shortens the electrical length of the second antenna while the wireless device does not use the second antenna. As a result, the wireless device of the present invention reduces the deterioration in the properties of the first antenna, in a case where the first antenna is used while the second antenna is not used.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

An object of the present invention is to provide a wireless device, which includes an antenna in one of two casings, and includes, in a joint part where the two casings are joined together, another antenna different from the antenna included in the casing, which wireless device is capable of reducing deterioration in properties of the antenna included in the casing. Particularly, the wireless device of the present invention is applicable to a mobile phone including two antennas that use different frequencies form each other, capable of utilizing a plurality of communication systems, and capable of both utilization of the communication system and reception of airwaves.

REFERENCE SIGNS LIST

1: Wireless Device
2: Wireless Device
3: Wireless Device
10: Upper Casing (First Casing)
11: Casing Antenna (First Antenna)
12: Transmission Element
20: Lower Casing (Second Casing)
21: Lower Casing Ground Pattern
22: Transmission Element
23: Matching Circuit (Matching Section)
26: Radio Unit Circuit (Signal Processing Section)
27: Transmission Element (Filter Element, Switching Element)
31: Hinge Part (Joint Part)
32: Built-in Antenna (Second Antenna)
33: Feeding Section (Coupling Section, First Conductor Section)
34: Feeding Section (Coupling Section, Second Conductor Section)

The invention claimed is:

1. A wireless device, comprising:

a first casing, housing a first antenna that resonates with a first frequency;

a second casing, housing a matching section for matching impedance with that of the first antenna, housing a first signal processing section, connected to the matching section, for processing a signal having the first frequency and housing a second signal processing section for processing a signal having a second frequency different from the first frequency;

a joint part, joining the first casing with the second casing, the joint part including a second antenna that resonates with the second frequency and including a coupling section for electrically coupling the matching section to the first antenna; and a transmission element, being disposed on a signal path that connects the second antenna and the second signal processing section, the transmission element (i) giving passage to the signal having the second frequency and (ii) blocking a signal having the first frequency.

2. The wireless device as set forth in claim 1, wherein:

the coupling section includes:

a first conductor section connected to the first antenna, and a second conductor section connected to the matching section, the first conductor section being electromagnetically coupled to the second conductor section.

3. The wireless device as set forth in claim 1, wherein:

the transmission element is a filter element.

4. The wireless device as set forth in claim 1, wherein:

the transmission element is a switching element that switches between electrically connecting and electrically disconnecting the second antenna and the second signal processing section, based on whether or not the second antenna is used.

5. The wireless device as set forth in claim 1, wherein:

the first antenna is used simultaneously with the second antenna.

* * * * *